US008272636B2

(12) United States Patent
Nakamura

(10) Patent No.: US 8,272,636 B2
(45) Date of Patent: Sep. 25, 2012

(54) PAPER FEED DEVICE, AND PAPER FEED CASSETTE, MANUAL PAPER FEED TRAY, AND IMAGE FORMING APPARATUS INCLUDING SAME

(75) Inventor: Mitsutaka Nakamura, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 522 days.

(21) Appl. No.: 12/222,613

(22) Filed: Aug. 13, 2008

(65) Prior Publication Data

US 2009/0045566 A1 Feb. 19, 2009

(30) Foreign Application Priority Data

Aug. 13, 2007 (JP) ..... 2007-210667

(51) Int. Cl.
*B65H 3/52* (2006.01)

(52) U.S. Cl. ..... 271/121

(58) Field of Classification Search ..... 271/121–125, 271/264, 110, 265.01–265.04, 104, 137, 271/167
See application file for complete search history.

(56) References Cited

U.S. PATENT DOCUMENTS

| | | | | |
|---|---|---|---|---|
| 4,765,605 | A | 8/1988 | Abbott | |
| 6,651,973 | B2 * | 11/2003 | Gaarder et al. | 271/117 |
| 6,788,440 | B1 * | 9/2004 | Sashida | 358/498 |
| 6,896,254 | B2 * | 5/2005 | Koh et al. | 271/117 |
| 7,460,824 | B2 * | 12/2008 | Nakajima et al. | 399/341 |
| 2002/0190460 | A1 * | 12/2002 | Gaarder et al. | 271/117 |
| 2005/0051945 | A1 | 3/2005 | Kang | |
| 2006/0232000 | A1 | 10/2006 | Takahashi et al. | |
| 2008/0084021 | A1 | 4/2008 | Nakamura | |

FOREIGN PATENT DOCUMENTS

| | | |
|---|---|---|
| JP | 02-049942 | 4/1990 |
| JP | 03-102039 | 4/1991 |
| JP | 5-22425 | 3/1993 |
| JP | 06-104510 | 12/1994 |
| JP | 07-330183 | 12/1995 |
| JP | 08-268580 | 10/1996 |
| JP | 09-110223 | 4/1997 |
| JP | 09-278212 | 10/1997 |
| JP | 11-310351 | 11/1999 |
| JP | 2000-118764 | 4/2000 |

(Continued)

OTHER PUBLICATIONS

European Search Report dated Dec. 30, 2008 for corresponding European Application No. 0816934.

(Continued)

*Primary Examiner* — Gerald McClain
*Assistant Examiner* — Thomas Morrison
(74) *Attorney, Agent, or Firm* — Harness, Dickey & Pierce, P.L.C.

(57) ABSTRACT

A paper feed device including a paper feed unit configured to feed sheets; a separation unit configured to separate and feed the sheets fed from the paper feed unit automatically one by one; a sheet guide member provided between the paper feed unit and the separation unit, the sheet guide member provided on a downstream side relative to a sheet feed direction rotatably supported at one edge thereof; and a guide driving member configured to change a sheet guide position of the sheet guide member depending on a sheet type.

12 Claims, 14 Drawing Sheets

FOREIGN PATENT DOCUMENTS

| | | |
|---|---|---|
| JP | 2000-264467 | 9/2000 |
| JP | 2001-031271 | 2/2001 |
| JP | 2001-063854 | 3/2001 |
| JP | 2002-002988 | 1/2002 |
| JP | 2003-118865 | 4/2003 |
| JP | 2004-035220 | 2/2004 |
| JP | 2005-060091 | 3/2005 |
| JP | 2006-103972 | 4/2006 |

OTHER PUBLICATIONS

Office Action for corresponding Japanese Patent Application No. 2007-210667 dated Oct. 7, 2011.

Office Action for corresponding Japanese Patent Application No. 2007-210667 dated Dec. 22, 2011.

* cited by examiner

PAPER FEED DEVICE, AND PAPER FEED CASSETTE, MANUAL PAPER FEED TRAY, AND IMAGE FORMING APPARATUS INCLUDING SAME

PRIORITY STATEMENT

The present patent application claims priority from Japanese Patent Application No. 2007-210667, filed on Aug. 13, 2007 in the Japan Patent Office, the entire contents of which are hereby incorporated herein by reference.

BACKGROUND

1. Technical Field

Example embodiments generally relate to a paper feed device configured to separate and feed sheets automatically one by one, and a paper feed cassette, a manual paper feed tray, and an image forming apparatus including the paper feed device.

2. Description of the Related Art

A related-art image forming apparatus, such as a copier, a facsimile machine, a printer, or a multifunction printer having two or more of copying, printing, scanning, and facsimile functions, forms a toner image on a recording medium (e.g., a sheet) according to image data using an electrophotographic method. In such a method, for example, a charger charges a surface of an image bearing member (e.g., a photoconductor); an optical scanning device emits a light beam onto the charged surface of the photoconductor to form an electrostatic latent image on the photoconductor according to the image data; the electrostatic latent image is developed with a developer (e.g., a toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

In recent years, such an image forming apparatus is required to have a function capable of handling a wider variety of sheet types, such as postcards, glossy paper, labels, very thick paper, and very thin paper. Because a relatively smaller number of sheets is generally used in a widely used image forming apparatus, there is not a big difference in paper feed property between when only a smaller number of sheets is set and when a larger number of sheets is set. Further, a manual paper feeder is often used for feeding specific sheets of paper.

However, demand for feeding a larger number of specific sheets of paper from a normal paper feed cassette have been increased in some categories of business, such as the medical and distribution industries. Examples of such specific sheets of paper include prescription medicine packets and delivery slips, and so forth.

Meanwhile, demand for more compact and less expensive image forming apparatuses continues to increase. An example of a widely used paper feed/separation device having one such sought-after compact, low-cost configuration employed in the image forming apparatus includes a friction pad system disclosed in published unexamined Japanese Patent application No. (hereinafter referred to as JP-A-) H07-330183. In the friction pad system, a paper feed unit including a paper feed roller and a paper feed pad, and a separation unit including a separation roller and a separation pad, are provided. Frequently, a single roller having a larger diameter is used to function as both the paper feed roller and the separation roller.

One important factor that determines the ability of the friction pad system to consistently separate individual sheets of paper properly is an entry angle of a sheet into the separation unit.

FIG. 1 is a schematic view illustrating a widely used related-art paper feed/separation device. Referring to FIG. 1, it can be seen that the paper feed/separation device includes a paper feed roller 101 provided on an upstream side relative to a paper feed direction Ph of a sheet P, and a paper feed pad 103 pressed against the paper feed roller 101 by a spring 102. The paper feed/separation device further includes a separation roller 104 provided on a downstream side from the paper feed roller 101 relative to the paper feed direction Ph, and a separation pad 106 pressed against the separation roller 104 by a spring 105.

A smaller number of the sheets P conveyed from a nip N1 between the paper feed roller 101 and the paper feed pad 103 is partially separated from one another by receiving a load, that is, a separation force, from the separation pad 106 when a leading edge thereof reaches the separation roller 104 before reaching a nip N2 between the separation roller 104 and the separation pad 106. Thereafter, the sheets P are completely separated from one another by a frictional force from the separation pad 106 at the nip N2, and conveyed automatically one by one to a conveyance path provided on a downstream side from the separation pad 106 relative to the paper feed direction Ph.

The separation force decreases when an entry angle θ of the sheet P, which is an angle formed between the paper feed pad 103 and the separation pad 106, becomes larger, and vice versa. Therefore, when the separation force is improperly set for the type of the sheets P to be processed, problems may occur. For example, when the entry angle θ is too large, i.e., the separation force is too small, the sheets P are conveyed to the nip N2 without being separated from one another at all. Consequently, the sheets P are not reliably separated from one another at the nip N2, possibly resulting in double feeding and paper jams. By contrast, when the entry angle θ is too small, i.e., the separation force is too large, all of the sheets P, for example, thick paper, may get stuck at the separation pad 106 before reaching the nip N2, possibly resulting in empty feeding.

To solve such problems, ideally, it is desirable to change the entry angle θ according to the type of the sheets P.

In the paper feed/separation device according to JP-A-H07-330183, an angle formed between the separation pad and a surface of a paper loading stand is set as the entry angle of the sheet into the separation unit, and the entry angle is adjustable. However, because the entry angle may be adjusted by changing an angle of the separation pad, a condition of conveyance of the sheet from an exit of the separation pad to the conveyance path provided on a downstream side from the separation pad is changed depending on how the angle of the separation pad is changed. Consequently, thin paper may be folded or thick paper may be unsuccessfully fed after passing through the exit of the separation pad.

A paper feed device disclosed in JP-A-2000-118764 includes the same configuration as that of the paper feed/separation device disclosed in JP-A-H07-330183.

In a paper feed device disclosed in a published unexamined Japanese utility model application No. H05-22425, an angle of a sheet supporting stand is adjustable so that settings for separating the sheets from one another may be selected according to the sheet type by controlling the effect of gravity on the sheets set on the sheet supporting stand. However, when the sheet supporting stand is set almost vertically, the sheets may flop over due to gravity, possibly causing diagonal feeding of the sheets.

A manual paper feed device disclosed in JP-A-2002-002988 includes a friction adjustment mechanism configured to change a frictional force exerted by a frictional separation pad. The frictional separation pad conveys sheets by sandwiching the sheet with a paper feed roller using the frictional force. Accordingly, sheets having a certain friction therebetween may be properly fed.

However, in the above-described device, sheets such as press-fitted sheets and glossy sheets, of which surfaces adhere to one another, may not be easily separated from one another by the friction adjustable mechanism described above. In order to reliably separate such sheets from one another, it is desirable to increase an entry angle of the sheets into a nip in a separation unit so that a separation force for separating the leading edge of the sheets from one another is increased.

As described above, in the paper feed/separation devices of the related art, the angle or position of the separation pad, the paper feed pad, or the sheet supporting stand is changed so as to properly separate the sheets from one another for each sheet type. However, it is difficult to change such an angle or a position once the paper feed/separation device is installed in the image forming apparatus as a finished product.

SUMMARY

In view of the foregoing, exemplary embodiments provide a paper feed device capable of reliably separating and feeding sheets automatically one by one, and a paper feed cassette, a manual paper feed tray, and an image forming apparatus including the paper feed device. Specifically, an entry angle of the sheet into a separation unit is adjustable without changing positions or angles of components provided in a paper feed unit and the separation unit so that an optimal setting for separating the sheets automatically one by one may be selected for each sheet type to perform proper separation and feeding of the sheets.

At least one embodiment provides a paper feed device including a paper feed unit configured to feed sheets; a separation unit configured to separate and feed the sheets fed from the paper feed unit automatically one by one; a sheet guide member provided between the paper feed unit and the separation unit, the sheet guide member provided on a downstream side relative to a sheet feed direction rotatably supported at one edge thereof; and a guide driving member configured to change a sheet guide position of the sheet guide member depending on a sheet type.

At least one embodiment provides a paper feed device including a paper feed unit configured to feed sheets; a separation unit configured to separate and feed the sheets fed from the paper feed unit automatically one by one; a sheet guide member including multiple members capable of moving relative to each other, provided between the paper feed unit and the separation unit; and a guide driving member configured to change a sheet guide position of the sheet guide member depending on a sheet type.

At least one embodiment provides a paper feed cassette including and a sheet storage and a paper feed unit configured to feed sheets automatically one by one from the sheet storage to a predetermined portion. The paper feed unit includes the paper feed device described above.

At least one embodiment provides a manual paper feed tray including a sheet supporting stand configured to support sheets and a paper feed unit configured to feed the sheets manually fed to a predetermined portion. The paper feed unit includes the paper feed device described above.

At least one embodiment provides an image forming apparatus including an image forming unit configured to form an image on a sheet and a paper feed unit configured to feed the sheet. The paper feed unit includes the paper feed cassette described above.

Additional features and advantages of the example embodiments will be more fully apparent from the following detailed description, the accompanying drawings, and the associated claims.

BRIEF DESCRIPTION OF THE DRAWINGS

A more complete appreciation of example embodiments and the many attendant advantages thereof will be readily obtained as the same becomes better understood by reference to the following detailed description when considered in connection with the accompanying drawings, wherein.

Figure 1:
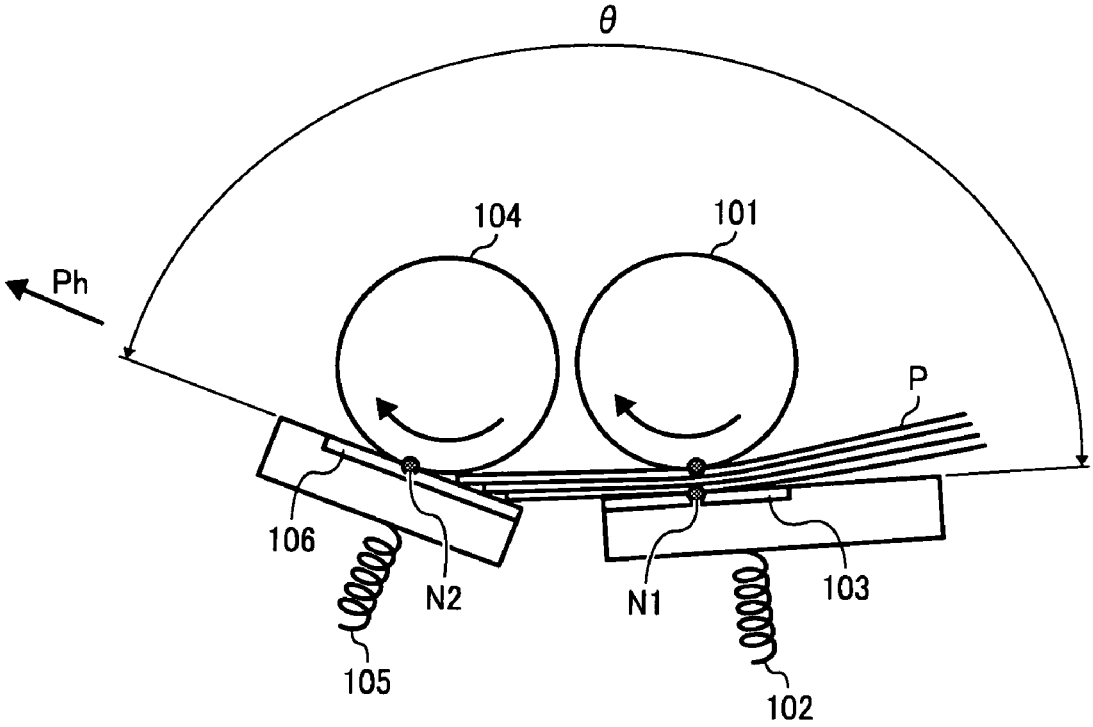
FIG. 1 RELATED ART
FIG. 1 is a schematic view illustrating a configuration of a paper feed/separation device of a related art.

The accompanying drawings are intended to depict example embodiments and should not be interpreted to limit the scope thereof. The accompanying drawings are not to be considered as drawn to scale unless explicitly noted.

DETAILED DESCRIPTION OF EXAMPLE EMBODIMENTS

In describing example embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Reference is now made to the drawings, wherein like reference numerals designate identical or corresponding parts throughout the several views.

Figure 2:
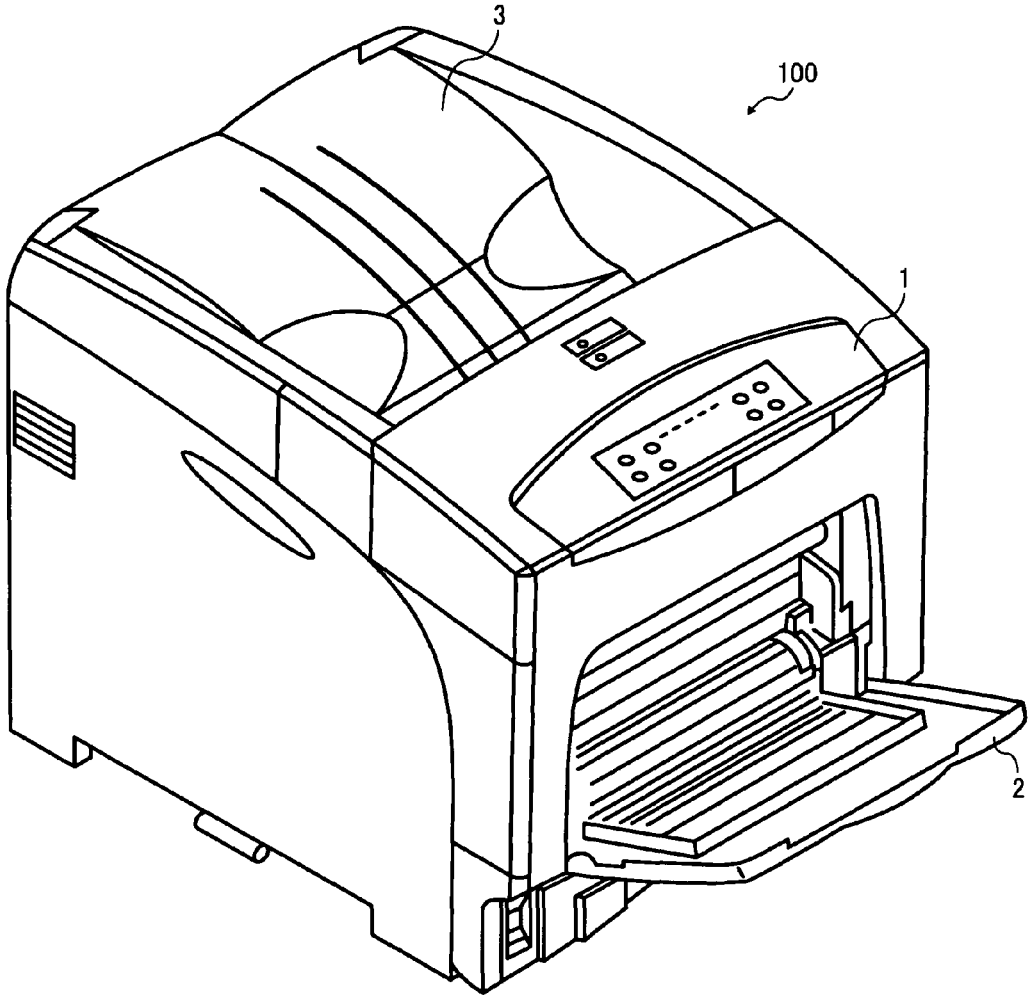
FIG. 2 is a perspective view illustrating an image forming apparatus according to example embodiments when a manual paper feed tray is opened.
Figure 3:
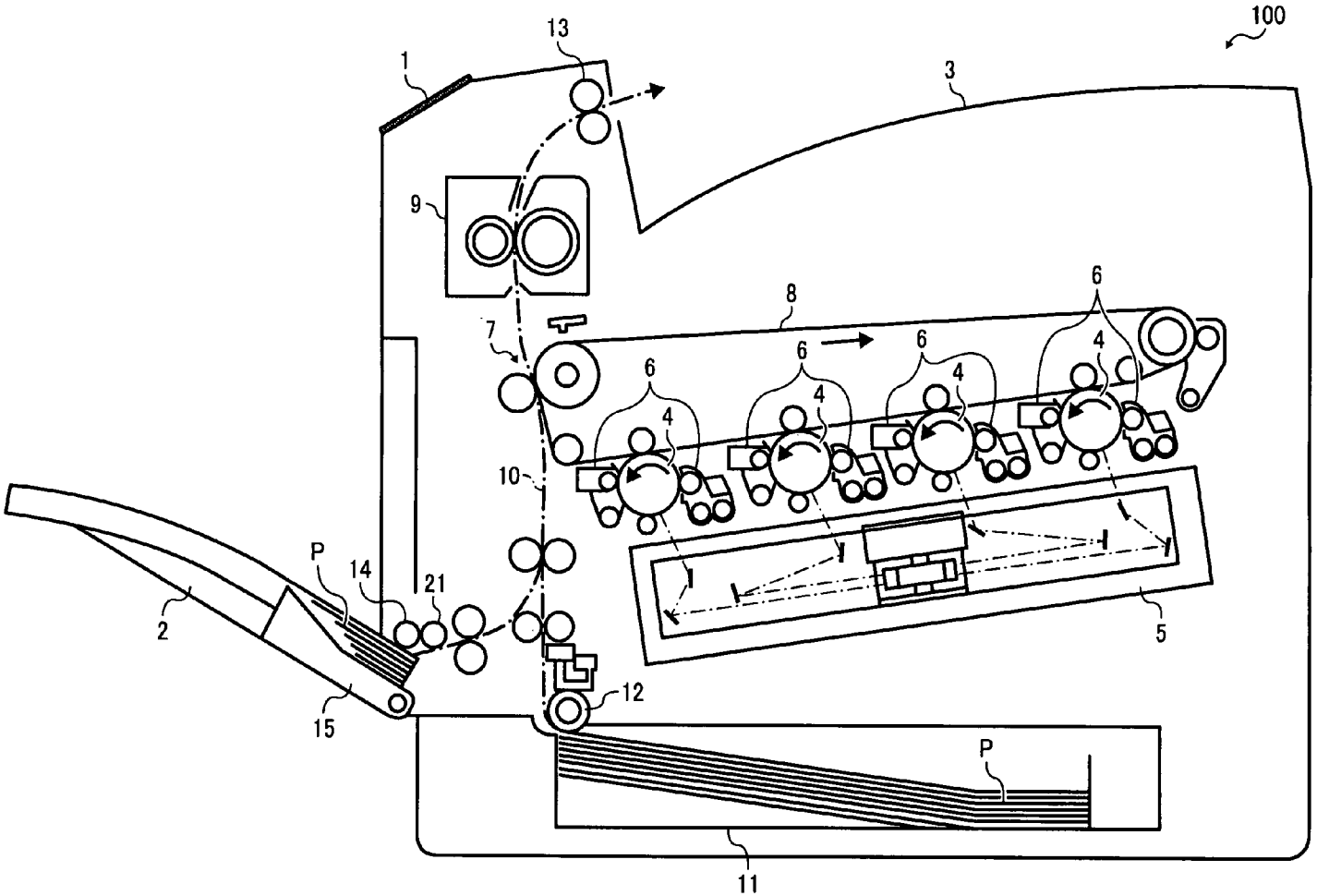
FIG. 3 is a vertical cross-sectional view illustrating a configuration of the image forming apparatus.

FIG. 2 is a perspective view illustrating a laser printer serving as an image forming apparatus according to example embodiments (hereinafter referred to as image forming apparatus 100), in a state in which a manual paper feed tray 2 thereof is opened. FIG. 3 is a vertical cross-sectional view illustrating a configuration of the image forming apparatus 100.

Referring to FIG. 2, the image forming apparatus 100 includes a display/control panel 1 including a display part for displaying various setting switches/buttons and modes at a top thereof, and the manual paper feed tray 2 for manually feeding sheets thereto at a bottom thereof. A sheet having an image formed by an image forming unit, to be described in detail later, provided in a main body of the image forming apparatus 100, is discharged to a discharge tray 3 provided at the top of the image forming apparatus 100.

Referring to FIG. 3, the image forming apparatus 100 includes the image forming unit including four photoconductive drums 4 corresponding to each of the four colors yellow (Y), magenta (M), cyan (C), and black (K); an optical writing unit 5 configured to direct laser light onto the photoconductive drums 4 to form electrostatic latent images on the photoconductive drums 4; electrophotographic process units 6 provided around each of the photoconductive drums 4 to develop the electrostatic latent images into visible toner images; an intermediate transfer belt 8 configured to transfer the toner images of each color respectively formed on surfaces of the photoconductive drums 4 onto a sheet P in a transfer device 7; and a fixing device 9 configured to fix the toner images on the sheet P.

A conveyance path 10 of the sheet P is provided inside the image forming apparatus 100 in a substantially vertical direction relative to the intermediate transfer belt 8 on a front side of the image forming apparatus 100 on which the display/control panel 1 is provided. A paper feed cassette 11 capable of being pulled open forward and configured to store the sheets P is provided in the lowest portion of the image forming apparatus 100. The sheet P is fed from the paper feed cassette 11 to the conveyance path 10 by a paper feed roller 12. The sheet P passes through the transfer unit 7 and the fixing device 9, and is discharged to the discharge tray 3 by a discharge roller 13.

In the manual paper feed tray 2 provided on the front side of the image forming apparatus 100, the sheet P stored on a sheet supporting stand 15 is fed by a manual paper feed roller 14 when paper feed is started. The sheet P passes through the conveyance path 10, the transfer unit 7, and the fixing device 9, and is discharged to the discharge tray 3 by the discharge roller 13.

Figure 4:
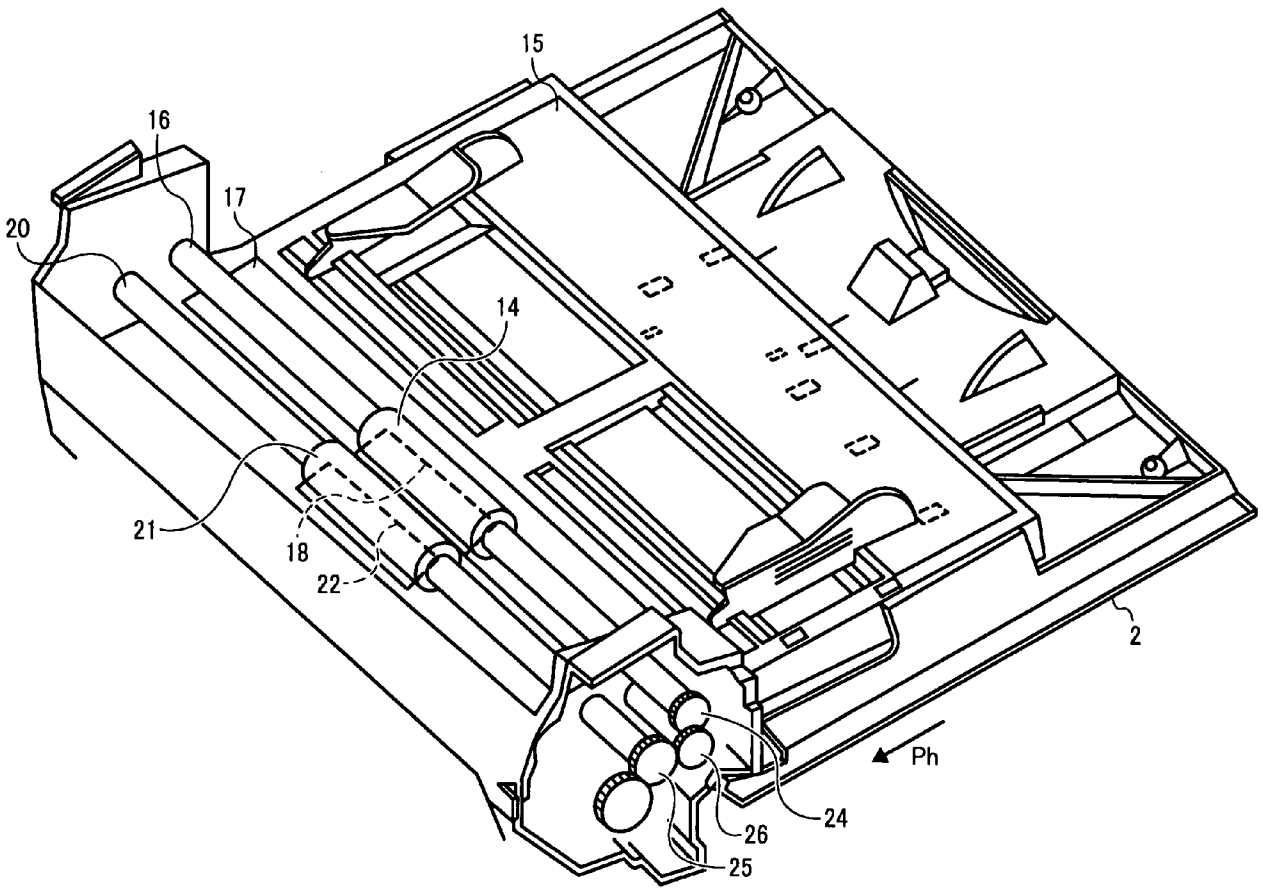
FIG. 4 is a perspective view illustrating a configuration of a manual paper feed tray unit including a manual paper feed tray according to exemplary embodiments.

FIG. 4 is a perspective view illustrating a configuration of a manual paper feed tray unit including the manual paper feed tray 2 according to exemplary embodiments.

Figure 5:
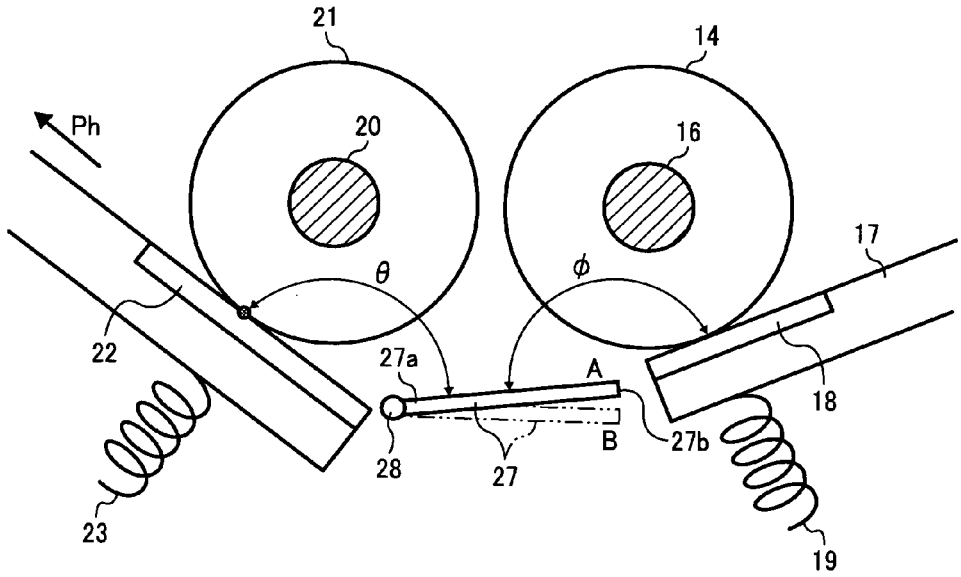
FIG. 5 is a vertical cross-sectional view illustrating a part of a basic configuration of a paper feed/separation part according to a first example embodiment in the manual paper feed tray unit.

Referring to FIG. 4, the sheet P is stored on the sheet supporting stand 15, and the manual paper feed roller 14 is provided on a paper feed roller rotation shaft 16. A bottom plate 17 is provided on an immediate downstream side from the sheet supporting stand 15 relative to a paper feed direction Ph. A paper feed pad 18 including a frictional material is provided on the bottom plate 17, and the bottom plate 17 is pressed against the manual paper feed roller 14 by a spring 19 as illustrated in FIG. 5.

A separation roller 21 is provided on a separation roller rotation shaft 20. A separation pad 22 including a frictional material is pressed against the separation roller 21 by a spring 23 as illustrated in FIG. 5.

As illustrated in FIG. 4, driven gears 24 and 25 are provided on the paper feed roller rotation shaft 16 and the separation roller rotation shaft 20, respectively, and a driving force is transmitted to the driven gears 24 and 25 from a motor, not shown, via an idler gear 26. Transmission of the driving force to the driven gears 24 and 25 is controlled by a clutch mechanism, not shown.

Alternatively, the driving force may be transmitted to the paper feed roller rotation shaft 16 and the separation roller rotation shaft 20 respectively from an independent driving source.

FIG. 5 is a vertical cross-sectional view illustrating a part of a basic configuration of a paper feed/separation part according to a first example embodiment in the manual paper feed tray unit.

Referring to FIG. 5, a paper feed part includes the manual paper feed roller 14, the paper feed pad 18, and the spring 19, and a separation part includes the separation roller 21, the separation pad 22, and the spring 23. A sheet guide member 27, an upper surface of which is configured to guide the sheet P, is provided between the paper feed part and the separation part.

The sheet guide member 27 has a plate-like shape, and an edge 27*a* thereof provided on a downstream side relative to the paper feed direction Ph is rotatably supported by a rotation shaft 28 such that the other edge 27*b* is a free edge capable of swinging in a substantially vertical direction. Accordingly, a position of a sheet guide surface of the sheet guide member 27 provided on an upper surface thereof may be changed by rotating the sheet guide member 27 in accordance with the type of sheet P fed from the sheet supporting stand 15.

In the first example embodiment, the user rotates the rotation shaft 28 so as to rotate the sheet guide member 27 around the rotation shaft 28 between a position A, indicated by a solid line in FIG. 5, and a position B, indicated by a dotted line in FIG. 5. As a result, the other edge 27*b* is moved so that an angle of the sheet guide member 27 is changed.

An entry angle θ of the sheet P into the separation pad 22 is identical to an angle formed between extended lines of each of the sheet guide surface of the sheet guide member 27 and the separation pad 22 as illustrated in FIG. 5. Although a preliminary separation force is generated by a guide separation angle Φ, which is identical to an angle formed between extended lines of each of the paper feed pad 18 and the sheet guide surface of the sheet guide member 27, the preliminary separation force is small because the sheet guide member 27 does not include a frictional material.

Figure 6:
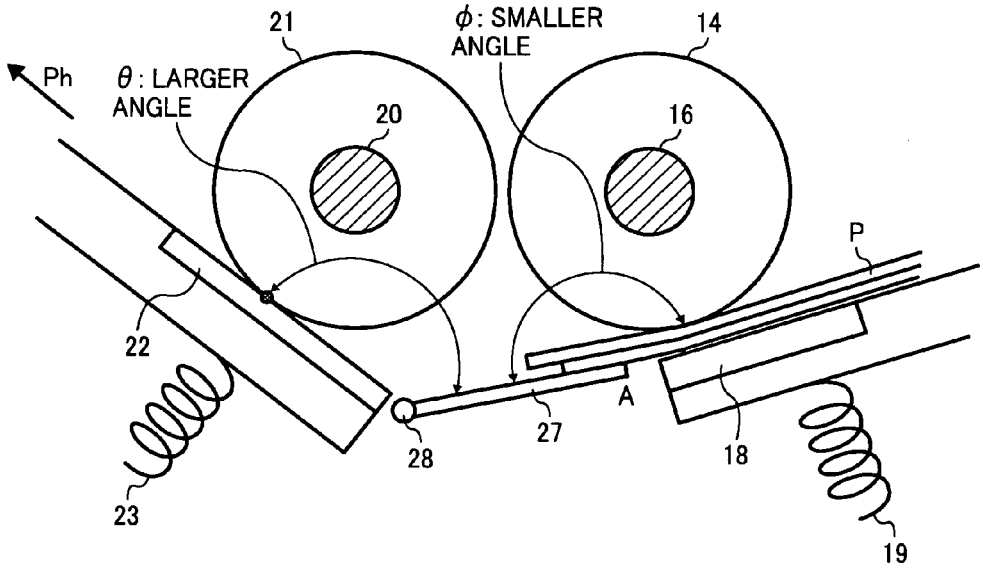
FIG. 6 is a vertical cross-sectional view illustrating an example of an operation of a sheet guide member according to the first example embodiment.

When the sheet guide member 27 is positioned at the position A, the entry angle θ becomes larger while the guide separation angle Φ decreases as illustrated in FIG. 6. When thick sheets or sheets with a higher elasticity are fed in such a state, those sheets are substantially separated from one another by the preliminary separation force generated by the guide separation angle Φ because the sheets originally have the characteristic of being easily separated from one another and causing empty feeding. Therefore, even when the guide separation angle Φ is larger while the separation force is smaller at the separation part, the sheets are separated from one another without being double-fed, and empty feeding of the sheets may be prevented due to a small conveyance load caused by the small separation force.

However, in a case in which thin sheets, sheets with a lower elasticity, or press-fitted sheets are fed when the sheet guide member 27 is positioned at the position A, those sheets are not separated from one another by the preliminary separation force generated by the guide separation angle Φ because the sheets originally have the characteristic of being not easily separated from one another and not causing empty feeding. Further, because the separation force is small at the separation part, the possibility of causing double feeding of the sheets is increased.

Figure 7:
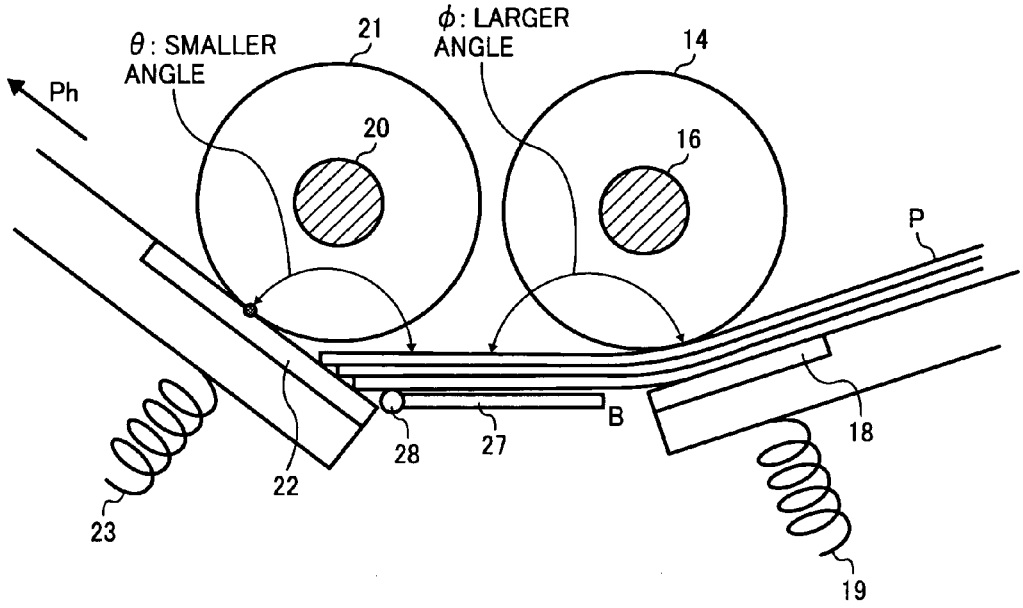
FIG. 7 is a vertical cross-sectional view illustrating another example of the operation of the sheet guide member according to the first example embodiment.

By contrast, when the position of the sheet guide member 27 is changed to the position B as illustrated in FIG. 7, the entry angle θ decreases while the guide separation angle Φ becomes larger. When thin sheets, sheets with a lower elasticity, or press-fitted sheets are fed in such a state, those sheets are not separated from one another by the preliminary separation force generated by the guide separation angle Φ. However, the sheets are separated from one another in the separation part because the separation force from the separation pad 22 is larger. As a result, the sheets are separated one by one at a nip portion between the separation pad 22 and the separation roller 21.

However, in a case in which thick sheets or sheets with a higher elasticity are fed when the sheet guide member 27 is positioned at the position B, the separation force at the separation part causes a larger load, possibly resulting in empty feeding of the sheets.

The above-described configuration according to the first exemplary embodiment allows the user to selectively change the entry angle θ of the sheet P into the nip portion in the separation part based on the type of sheet P. Accordingly, various types of sheets with a variety of different thicknesses selected by the user may be properly fed one by one.

Figure 8:
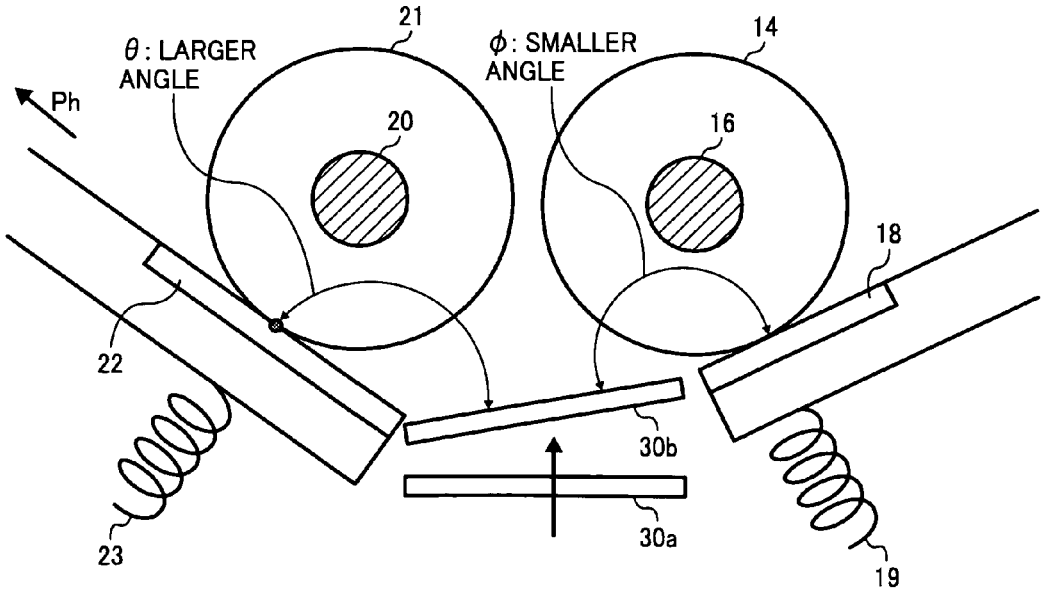
FIG. 8 is a vertical cross-sectional view illustrating a configuration and operations of a paper feed/separation part according to a second example embodiment in the manual paper feed tray unit.
Figure 9:
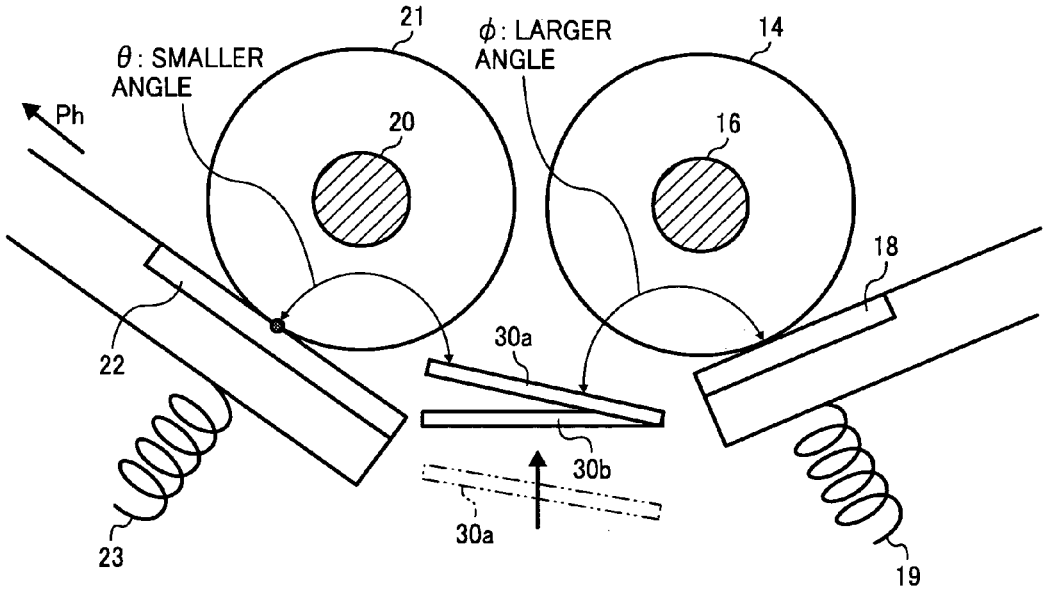
FIG. 9 is a vertical cross-sectional view illustrating an operation of a sheet guide member according to the second example embodiment.
Figure 10:
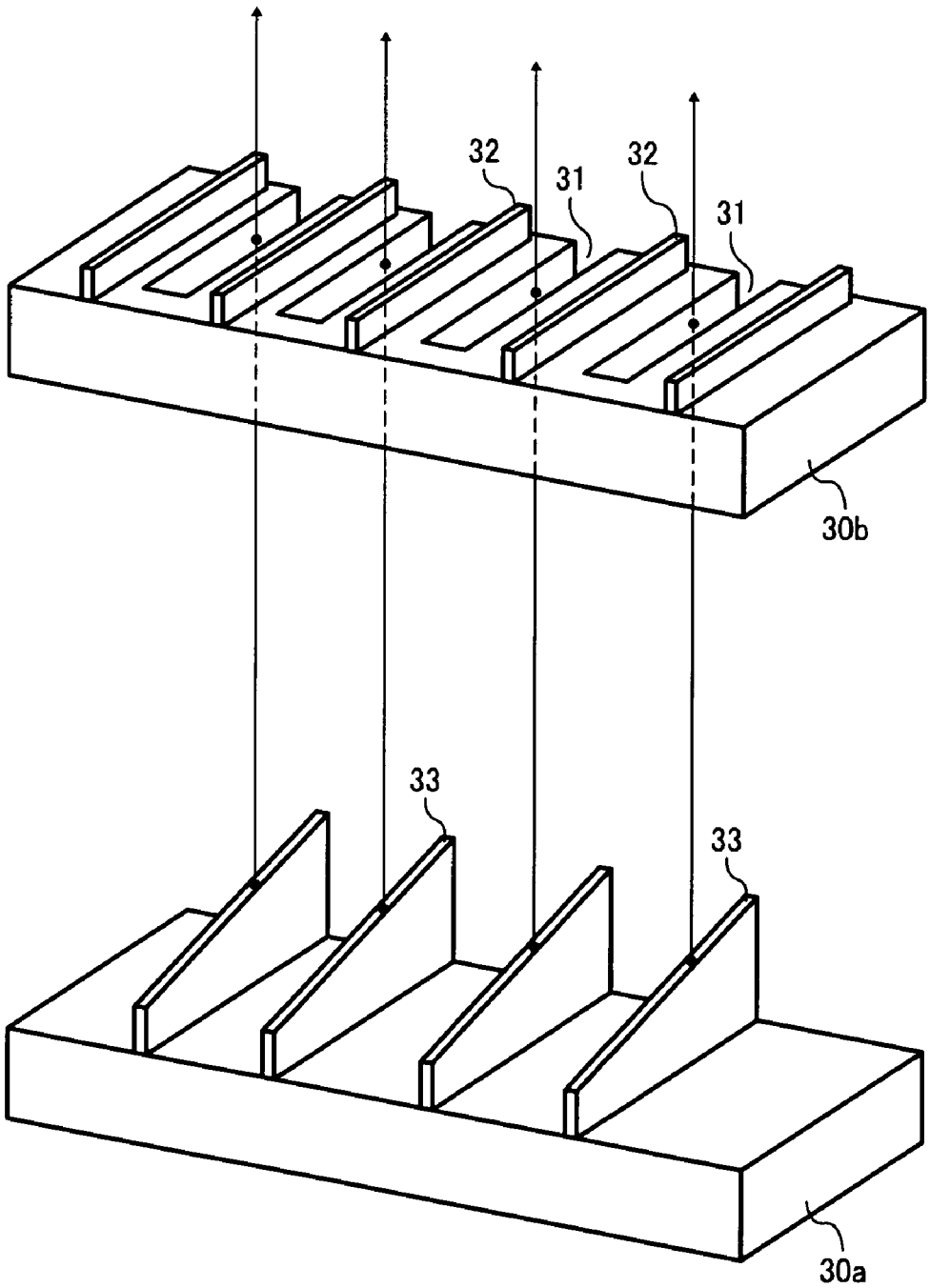
FIG. 10 is an exploded perspective view illustrating the sheet guide member according to the second example embodiment.

A basic configuration of the sheet feed/separation part according to a second example embodiment in the manual paper feed tray unit is described in detail below with reference to FIGS. 8 through 10. FIGS. 8 and 9 are vertical cross-sectional views illustrating operations of the sheet feed/separation part according to the second example embodiment. FIG. 10 is an exploded perspective view illustrating a sheet guide member according to the second example embodiment.

The sheet guide member according to the second example embodiment includes multiple guide members capable of moving relative to each other. In the second example embodiment, the sheet guide member includes two guide members, a first guide member 30*a* and a second guide member 30*b*. The second guide member 30*b* is fixed, and the first guide member 30*a*, a shape and a position of which are different from those of the second guide member 30*b*, is movably provided relative to the second guide member 30*b*. More specifically, as illustrated in FIG. 10, the first guide member 30*a* is slidably provided in a vertical direction relative to the second guide member 30*b*. The second guide member 30*b* includes ribs 32 protruding upward between slits 31 such that vertical movement of the first guide member 30*a* is not prevented by the second guide member 30*b*. Moreover, the first guide member 30*a* includes ribs 33 having a comb-like shape which pass through the slits 31 of the second guide member 30*b* to protrude further than the ribs 32.

In the second example embodiment, the user operates a guide driving member, not shown, to move the first guide member 30*a*. When the first guide member 30*a* is moved to a lower position as illustrated in FIG. 8, a sheet guide surface of the second guide member 30*b* separates the sheets P from one another. On the other hand, when the first guide member 30*a* is moved to a higher position as illustrated in FIG. 9, a sheet guide surface of the first guide member 30*a* separates the sheets P from one another.

The above-described configuration according to the second example embodiment allows the user to select the positions of the sheet guide member, thereby achieving the same effect as that achieved in the first example embodiment.

Figure 11:
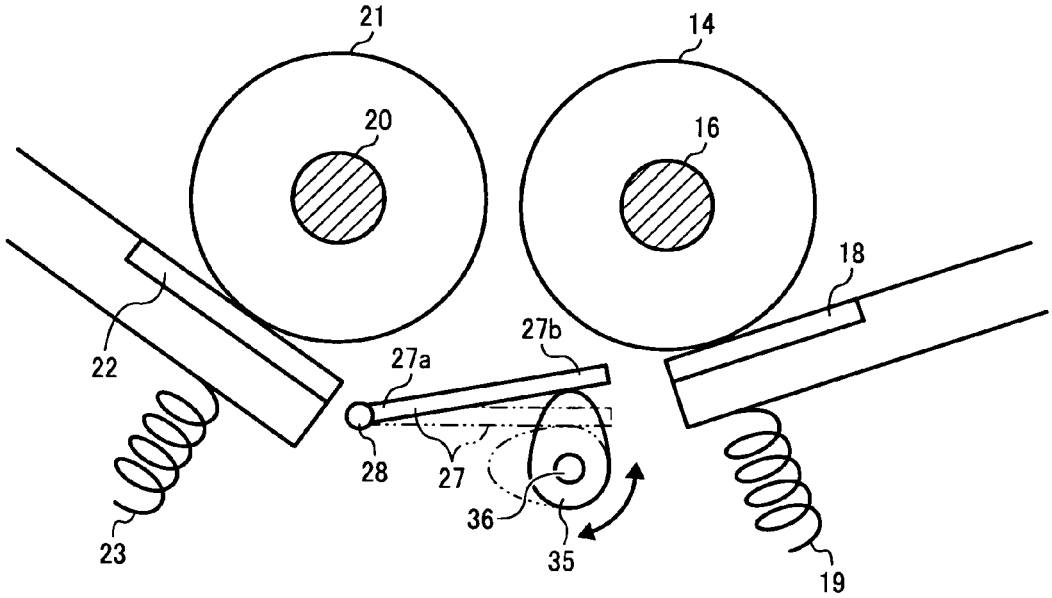
FIG. 11 is a vertical cross-sectional view illustrating a paper feed/separation part according to a third example embodiment in the manual paper feed tray unit.

FIG. 11 is a vertical cross-sectional view illustrating a basic configuration of a paper feed/separation part according to a third example embodiment in the manual paper feed tray unit. Similarly to the first example embodiment, the edge 27*a* of the sheet guide member 27 is rotatably supported by the rotation shaft 28. In addition, a cam drive shaft 36 and an eccentric cam 35 provided on the cam drive shaft 36 are provided below the other edge 27*b* of the sheet guide member 27. Accordingly, a sheet guide position of the sheet guide member 27, that is, an angle of the sheet guide member 27, may be changed by a combination of own weight of the sheet guide member 27 and rotation of the cam drive shaft 36 and the eccentric cam 35.

Figure 12:
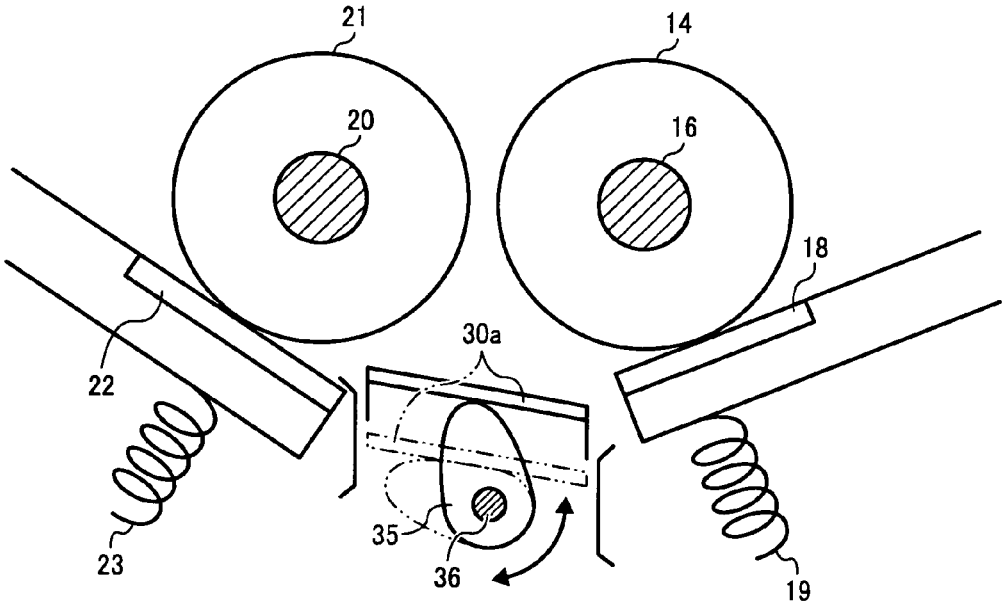
FIG. 12 is a vertical cross-sectional view illustrating a paper feed/separation part according to a fourth example embodiment in the manual paper feed tray unit.

FIG. 12 is a vertical cross-sectional view illustrating a basic configuration of a paper feed/separation part according to a fourth example embodiment in the manual paper feed tray unit. Similarly to the second example embodiment, the sheet guide member according to the fourth example embodiment includes multiple guide members capable of moving relative to each other. The paper feed/separation part according to the fourth example embodiment includes the cam drive shaft 36 and the eccentric cam 35 provided on the cam drive shaft 36 below the first guide member 30*a* movably provided. Accordingly, the angle of the first guide member 30*a* may be changed by a combination of own weight of the first guide member 30*a* and rotation of the eccentric cam 35 and the cam drive shaft 36.

The configurations according to the third and fourth example embodiments described above allow the guide driving member to be formed only by a cam and a shaft, thereby reducing costs and space.

Figure 13:
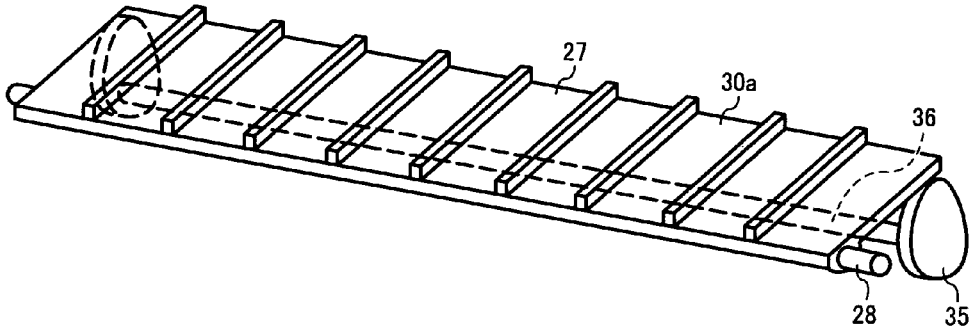
FIG. 13 is a perspective view illustrating an example of a configuration of a guide driving member in which an eccentric cam and a cam drive shaft are integrally formed.

As illustrated in FIG. 13, the eccentric cam 35 and the cam drive shaft 36 may be integrally formed as one component, thereby further reducing costs.

Figure 14:
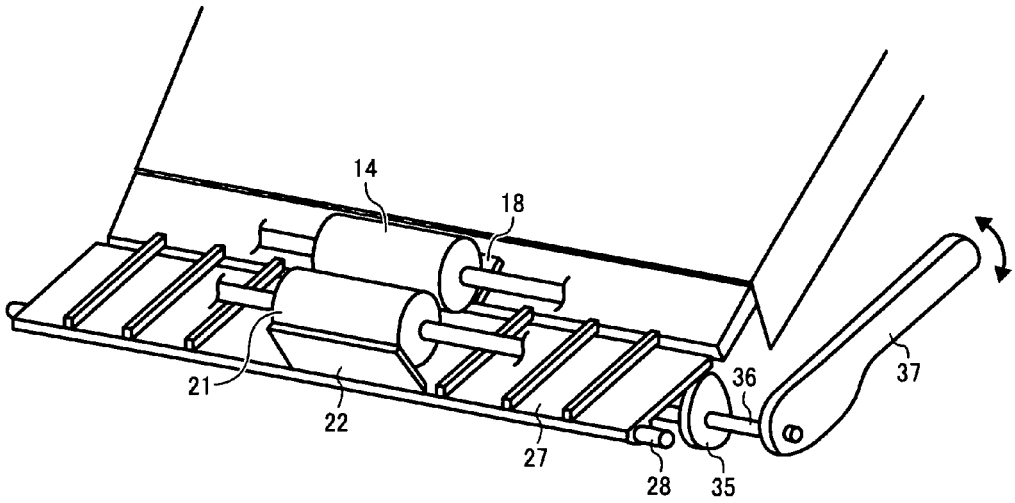
FIG. 14 is a perspective view illustrating main components of a paper feed/separation part according to a fifth example embodiment in the manual paper feed tray unit.

FIG. 14 is a perspective view illustrating main components of a paper feed/separation part according to a fifth example embodiment in the manual paper feed tray unit. In the fifth example embodiment, the guide driving member including the eccentric cam 35 and the cam drive shaft 36 according to the third example embodiment is manually operated by the user.

In FIG. 14, a lever 37 serving as a manual operation member is provided on an edge of the cam drive shaft 36. The eccentric cam 35 is rotated by vertical rotation of the lever 37 through the cam drive shaft 36, thereby facilitating rotation of the sheet guide member 27.

It is to be noted that, as a variation thereof, the lever 37 may be provided on the cam drive shaft 36 according to the fourth example embodiment illustrated in FIG. 12.

The configuration according to the fifth example embodiment described above allows the user to easily change the angle of the sheet guide member 27 by operating the lever 37.

Figure 15:
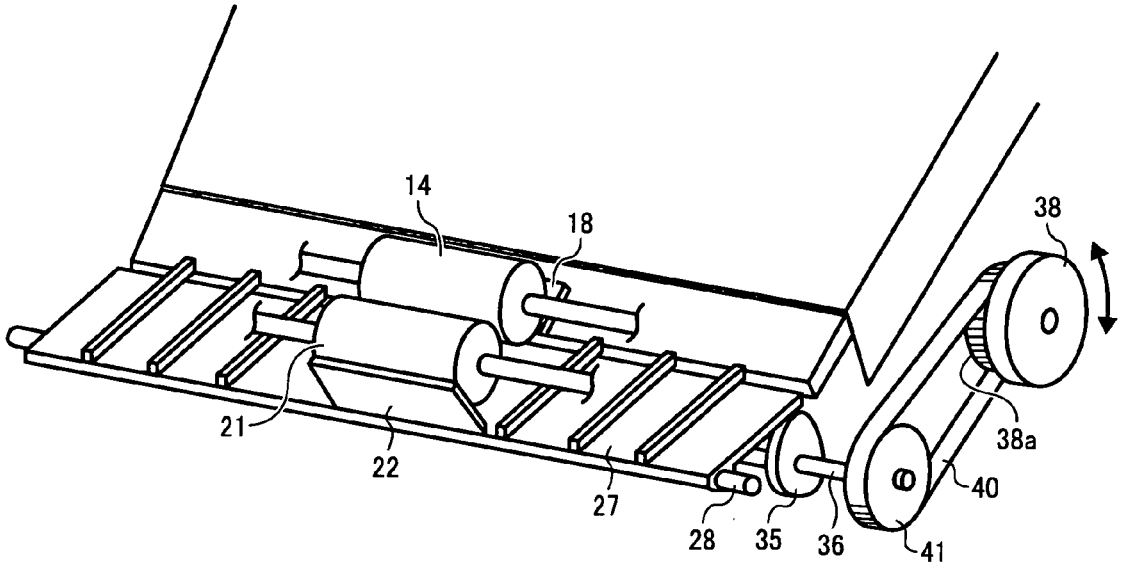
FIG. 15 is a perspective view illustrating main components of a paper feed/separation part according to a sixth example embodiment in the manual paper feed tray unit.

FIG. 15 is a perspective view illustrating main components of a paper feed/separation part according to a sixth example embodiment in the manual paper feed tray unit. In the sixth example embodiment, a dial 38 having a gear 38*a* on a side portion thereof is provided as the manual operation member for the guide driving member.

The gear 38*a* is connected to a driving gear 41 provided on the cam drive shaft 36 via a timing belt 40 so that the dial 38 is rotated along with the rotation of the driving gear 41.

The above-described configuration allows the user to easily change the angle of the sheet guide member 27 by rotating the dial 38.

Further, the angle of the sheet guide member 27 may be changed using the entire circumference of the eccentric cam 35 via the dial 38. Accordingly, the angle of the sheet guide member 27 may be changed in a wider range with more steps, thereby handling a wider variety of sheet types.

When the angle of the sheet guide member 27 is manually changed by the user as described above, it is desirable that the user may feel a click each time the sheet guide member 27 reaches a predetermined angle, in order to prevent the user from improper setting of the position of the lever 37 or the dial 38.

Figure 16:
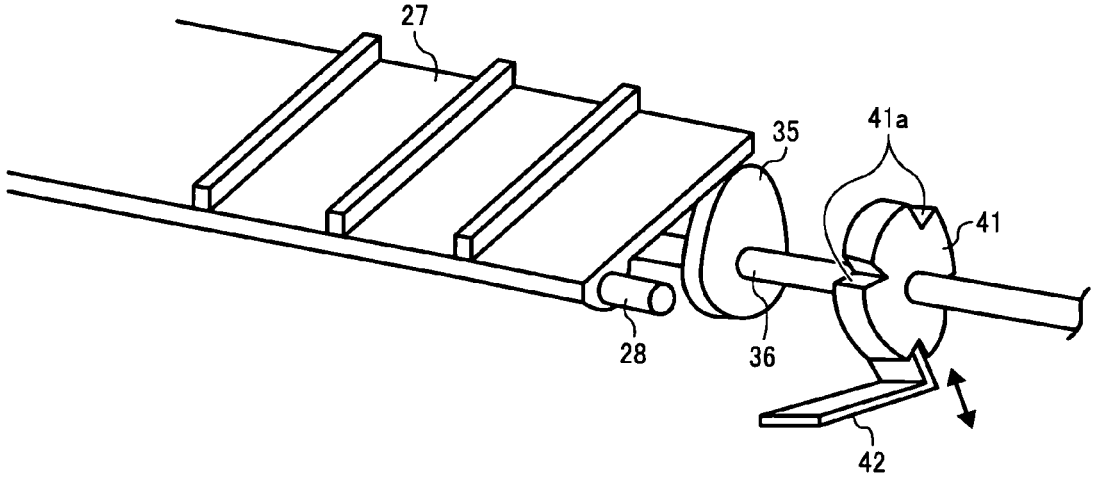
FIG. 16 is a perspective view illustrating an example of a configuration of a mechanism configured to provide a click feeling to a user during operation.

For example, as illustrated in FIG. 16, a disk 41 having multiple engagement notches 41*a* along a circumference thereof is provided on the cam drive shaft 36. Further, a locking pick 42 made of an elastic material with flexibility is provided in the vicinity of the disk 41. The locking pick 42 engages one of the engagement notches 41*a* at each rotation angle of the eccentric cam 35 corresponding to the angle of the sheet guide member 27 so that the user may feel a click.

The above-described configuration allows the user to reliably change the angle of the sheet guide member 27 without erroneous operations.

Figure 17:
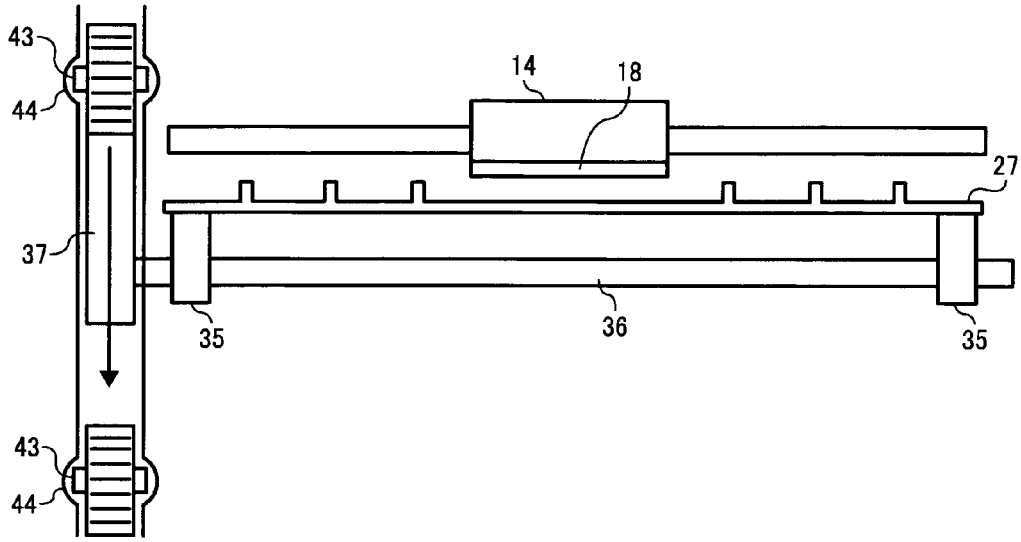
FIG. 17 is a schematic view illustrating another example of the configuration of the mechanism configured to provide a click feeling to the user during operation.

Alternatively, as illustrated in FIG. 17, an engagement convex portion 43 may be provided on the lever 37 illustrated in FIG. 14. In addition, multiple concave portions 44 may be provided corresponding to the rotation angle of the eccentric cam 35, that is, the angle of the sheet guide member 27, as a locking member capable of engaging with/disengaging from the engagement convex portion 43 in a moving area of the lever 37. Accordingly, the user may feel a click during the operation in a similar way as in the case described above.

Figure 18:
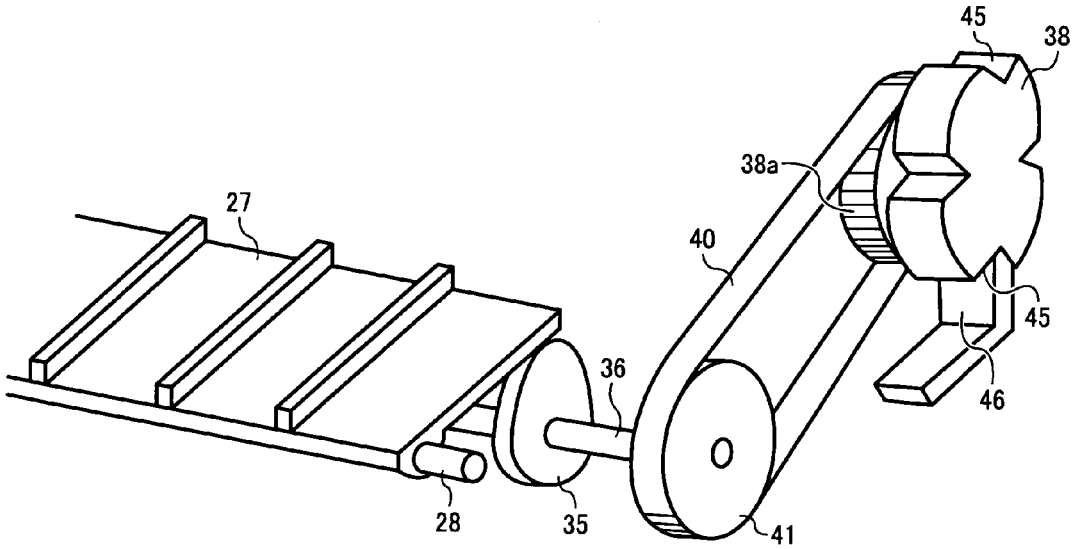
FIG. 18 is a perspective view illustrating yet another example of the configuration of the mechanism configured to provide a click feeling to the user during operation.

Further alternatively, as illustrated in FIG. 18, multiple engagement notches 45 may be provided along a circumference of the dial 38 illustrated in FIG. 15 corresponding to the rotation angle of the eccentric cam 35, that is, the angle of the sheet guide member 27. In addition, a locking pick 46 made of an elastic material with flexibility is provided in the vicinity of the dial 38 such that the locking pick 46 engages and disengages from the multiple engagement notches 45.

Such a configuration allows the user to feel a click each time the dial 38 reaches a predetermined angle.

Figure 19:
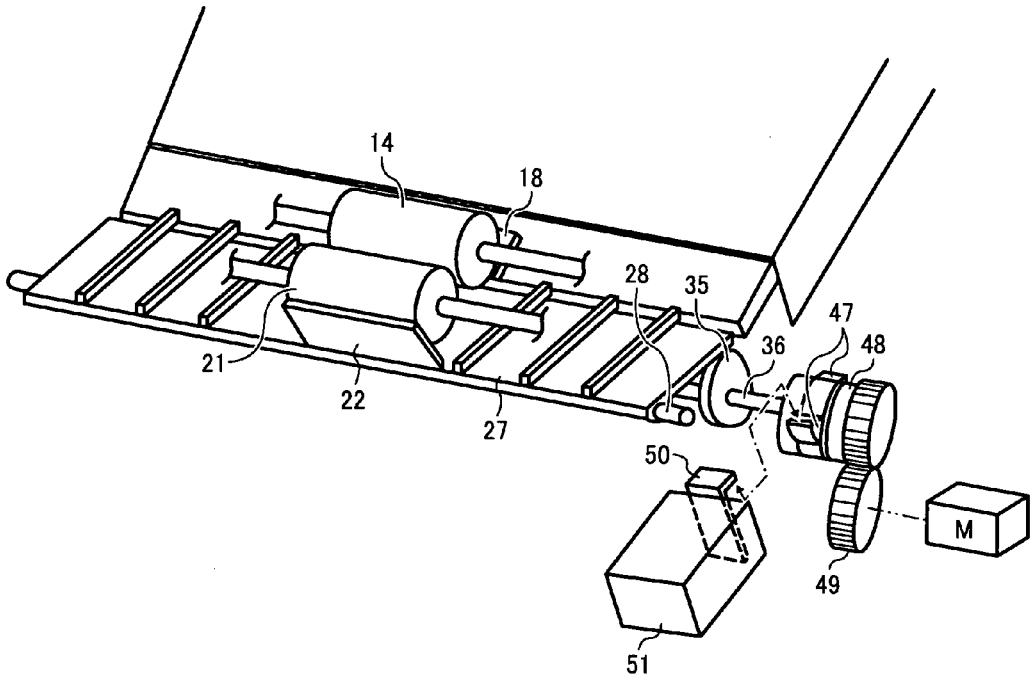
FIG. 19 is a perspective view illustrating main components of a paper feed/separation part according to a seventh example embodiment.
Figure 20:
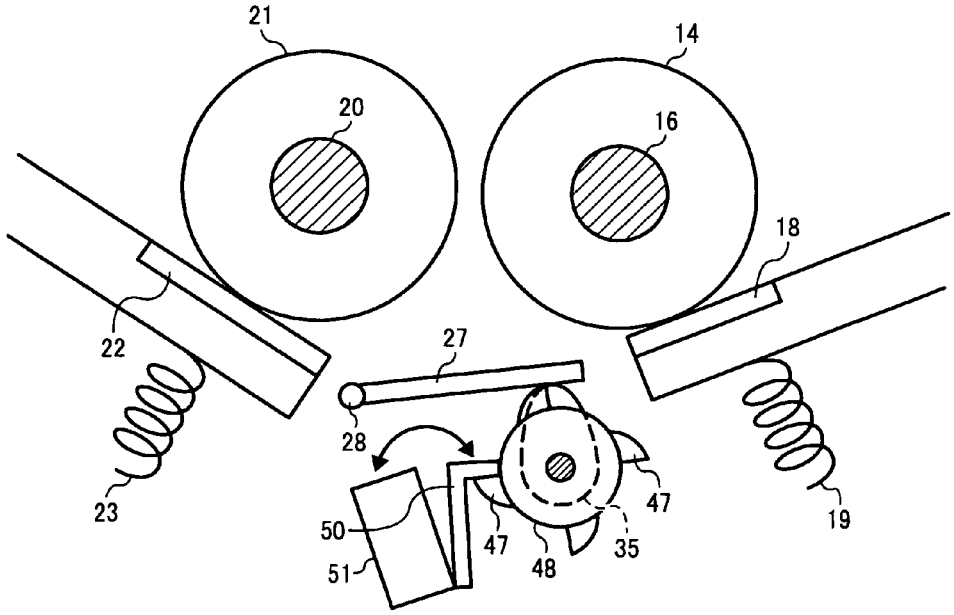
FIG. 20 is a vertical cross-sectional view illustrating the paper feed/separation part according to the seventh example embodiment.

FIG. 19 is a perspective view illustrating main components of a paper feed/separation part according to a seventh example embodiment in the manual paper feed tray unit. FIG. 20 is a vertical cross-sectional view illustrating a configuration of the paper feed/separation part according to the seventh example embodiment. In contrast to earlier embodiments, in the seventh example embodiment, the guide driving member including the eccentric cam 35 and the cam drive shaft 36 configured to change the angle of the sheet guide member 27 is automatically driven by a driving source such as, for example, a motor, instead of being operated manually.

As illustrated in FIG. 19, in the guide driving member according to the seventh example embodiment, a spring clutch 48 having picks 47 along a circumference thereof and a driving gear 49 capable of transmitting a driving force from a motor M are provided on the cam drive shaft 36. A number of the picks 47 provided along the circumference of the spring clutch 48 needs to be larger than a number of angles set for the sheet guide member 27. Further, an electromagnetic solenoid 51 having a flapper 50 is provided such that the flapper 50 engages and disengages from the picks 47. The rotation angle of the eccentric cam 35 is configured to be detected by a detector, not shown, or the like, in a row or each time the angle of the sheet guide member 27 is changed.

According to the seventh example embodiment, the user inputs the type of paper P when inputting print data through the display/control panel 1 of the image forming apparatus 100. A central processing unit (CPU), not shown, provided in the image forming apparatus 100 checks the angle of the sheet guide member 27 currently set and a proper angle thereof capable of handling the sheet P based on an input signal and a detection signal. Subsequently, the CPU drives the motor M to repeatedly turn on and off the electromagnetic solenoid 51 at certain predetermined intervals so that the angle, the position, and the shape of the sheet guide member 27 are properly changed according to the type of the sheet P.

Such a configuration allows the angle of the sheet guide member 27 to be automatically changed without requiring performance of complicated operations by the user.

Because paper feed/separation settings are selected based on the type of sheet P in the seventh example embodiment, it is desirable that the user may visually confirm which position of the sheet guide member 27 is currently selected.

Figure 21:
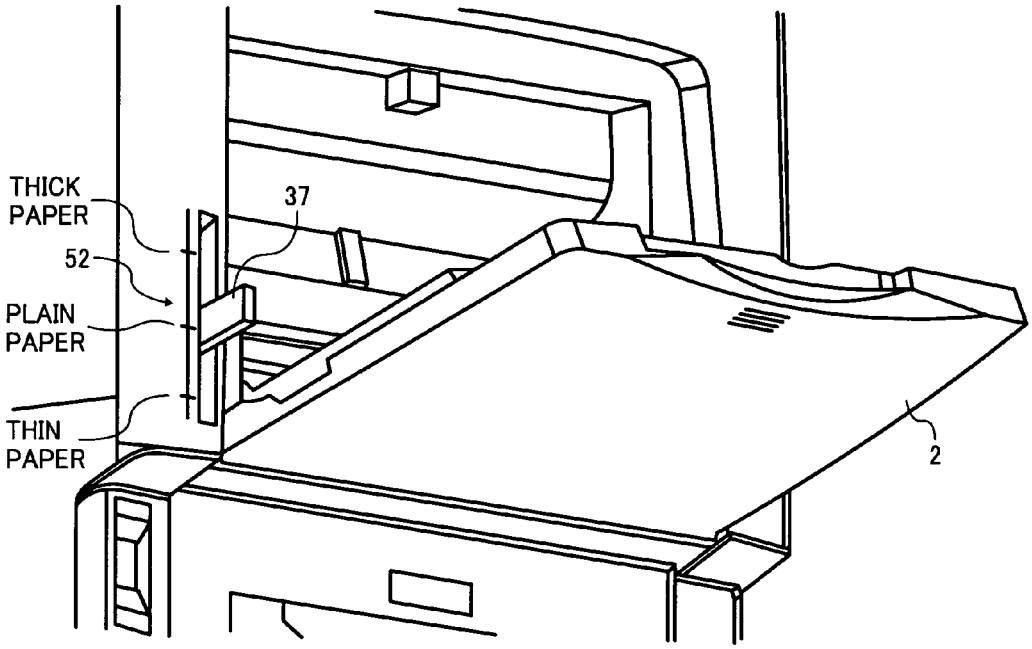
FIG. 21 is a perspective view illustrating an example of a display member configured to display a type of a sheet currently selected according to example embodiments.
Figure 22:
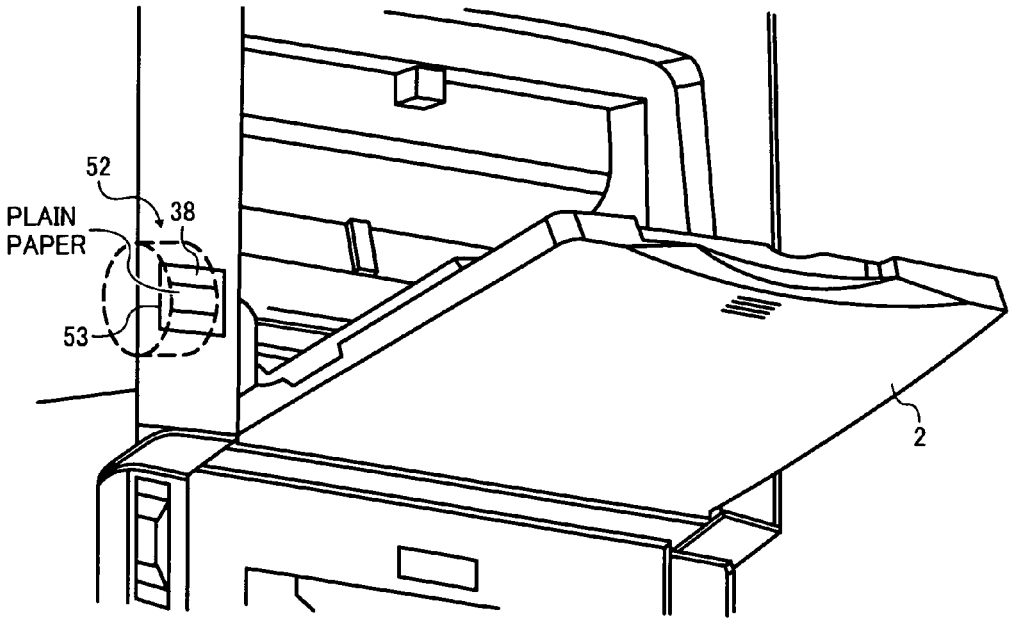
FIG. 22 is a perspective view illustrating another example of the display member.

For example, as illustrated in FIGS. 21 and 22, a display member 52 may be provided in the vicinity of the manual paper feed tray 2 to enable the user to visually confirm whether the position of the sheet guide member 27 is properly set according to the type of the sheet P. An example of a configuration of the display member 52 illustrated in FIG. 21 uses a part of the lever 37 according to the fifth example embodiment illustrated in FIG. 14, such that the position of the sheet guide member 27 currently selected according to the type of sheet P may be displayed using the rotation angle of the lever 37. In another example of the configuration of the display member 52 illustrated in FIG. 22, the position of the sheet guide member 27 according to the type of sheet P is displayed on an outer circumference of the dial 38 according to the sixth example embodiment illustrated in FIG. 15 so that the position of the sheet guide member 27 currently selected according to the type of sheet P is displayed using the rotation angle of the dial 38, enabling the user to confirm which position of the sheet guide member 27 is currently selected from a window 53 provided on the main body of the image forming apparatus 100.

When the lever 37 is used as illustrated in FIG. 21, the lever 37 and the display member 52 may be separately provided, although it is preferable that the lever 37 and the display member 52 are provided together from the viewpoint of reducing the number of components.

The above-described configurations allow the user to easily check whether or not the angle, the position, and the shape of the sheet guide member 27 are properly set corresponding to the type of sheet P without operating the image forming apparatus 100.

The foregoing example embodiments are applicable to a paper feed/separation part provided other than the manual paper feed tray 2, such as, for example, the paper feed cassette 11 illustrated in FIG. 3. Further, the foregoing example embodiments are applicable to a paper feed device such as a paper feed cassette capable of storing a larger number of sheets or a paper feed tray capable of handling a wider variety of sheet types.

The paper feed cassette and the manual paper feed tray according to the foregoing example embodiments are applicable to the image forming apparatus 100 illustrated in FIGS. 2 and 3 as well as image forming apparatuses such as a copier and a facsimile machine.

The foregoing example embodiments may be effectively employed in a paper feed/separation device used in a laser printer, an inkjet printer, a copier, and a complex machine having functions of the printer and the copier, or an image forming apparatus.

Example embodiments are not limited to the details described above, and various modifications and improvements are possible without departing from the spirit and scope of example embodiments. It is therefore to be understood that, within the scope of the associated claims, example embodiments may be practiced otherwise than as specifically described herein. For example, elements and/or features of different illustrative example embodiments may be combined with each other and/or substituted for each other within the scope of example embodiments.

What is claimed is:

1. A paper feed device, comprising:

a paper feed unit configured to feed sheets, the paper feed unit includes a paper feed roller and a paper feed pad;

a separation unit configured to separate and feed the sheets fed from the paper feed unit automatically one by one, the separation unit includes a separation roller and a separation pad;

a sheet guide member, configured to guide the sheets during sheet feeding, provided between the paper feed unit and the separation unit, the sheet guide member provided on a downstream side relative to a sheet feed direction pivotably supported at one edge thereof to pivot between a first guiding position and a second guiding position; and a guide driving member configured to change a sheet guide position of the sheet guide member depending on a sheet type, wherein the guide driving member is an eccentric cam, and wherein the guide driving member presses against a back surface of the sheet guide member to change the sheet guide position of the sheet guide member.

2. The paper feed device according to claim 1, further comprising a display member configured to display a sheet guide position of the sheet guide member currently set by association with a change in the sheet guide position of the sheet guide member.

3. A paper feed cassette, comprising:

a sheet storage; and a paper feed unit configured to feed sheets automatically one by one from the sheet storage to a predetermined portion, wherein the paper feed unit comprises the paper feed device according to claim 1.

4. A manual paper feed tray, comprising:

a sheet supporting stand configured to support sheets; and a paper feed unit configured to feed the sheets manually fed to a predetermined portion, wherein the paper feed unit comprises the paper feed device according to claim 1.

5. An image forming apparatus, comprising:

an image forming unit configured to form an image on a sheet; and a paper feed unit configured to feed the sheet, wherein the paper feed unit comprises the paper feed cassette according to claim 3.

6. A paper feed device, comprising:

a paper feed unit configured to feed sheets, the paper feed unit includes a paper feed roller and a paper feed pad;

a separation unit configured to separate and feed the sheets fed from the paper feed unit automatically one by one, the separation unit includes a separation roller and a separation pad;

a sheet guide member, configured to guide the sheets during sheet feeding, including at least two members capable of moving relative to each other between a first guiding position and a second guiding position, provided between the paper feed unit and the separation unit; and a guide driving member configured to change a sheet guide position of the sheet guide member depending on a sheet type, wherein the guide driving member is an eccentric cam, and wherein the guide driving member presses against a back surface of the sheet guide member to change the sheet guide position of the sheet guide member.

7. The paper feed device according to claim 6, wherein the sheet guide member includes a first guide member and a second guide member.

8. The paper feed device according to claim 7, wherein a shape and position of the first guide member is different from a shape and position of the second guide member.

9. The paper feed device according to claim 7, wherein the first guide member is movable relative to the second guide member.

10. The paper feed device according to claim 9, wherein the first guide member is slideable in a vertical direction relative to the second guide member.

11. The paper feed device according to claim 10, wherein the second guide member includes ribs protruding upward between slits thereof such that vertical movement of the first guide member is not prevented by the second guide member.

12. The paper feed device according to claim 11, wherein the first guide member includes ribs having a comb-like shape which pass through the slits of the second guide member which protrude further than the ribs of the second guide member.

* * * * *